United States Patent [19]

Welsh et al.

[11] Patent Number: 5,046,964

[45] Date of Patent: Sep. 10, 1991

[54] HYBRID CONNECTOR

[75] Inventors: David E. Welsh, Tustin; Piyapote Pisalyaput, Irvine; William C. Gore, San Bernardino, all of Calif.

[73] Assignee: ITT Corporation, New York, N.Y.

[21] Appl. No.: 419,406

[22] Filed: Oct. 10, 1989

[51] Int. Cl.[5] ..... H01R 13/52

[52] U.S. Cl. ..... 439/271; 439/321; 439/609

[58] Field of Search ..... 439/92, 95, 108, 607, 439/609, 610, 271-277, 320, 321

[56] References Cited

U.S. PATENT DOCUMENTS

| | | | |
|---|---|---|---|
| 3,040,287 | 6/1962 | Agron et al. | 439/320 X |
| 3,391,381 | 7/1968 | Livingston | 439/610 |
| 3,521,222 | 7/1970 | Andrews | 439/609 |
| 3,594,700 | 7/1971 | Nava | 439/321 X |
| 3,609,636 | 9/1971 | Kubin et al. | 439/277 |
| 3,850,495 | 11/1974 | Glover | 439/273 |
| 4,074,927 | 2/1978 | Ball | 439/315 |
| 4,106,839 | 8/1978 | Cooper | 439/609 |
| 4,109,990 | 8/1978 | Waldron et al. | 439/321 |
| 4,239,314 | 12/1980 | Anderson et al. | 439/321 |
| 4,310,213 | 1/1982 | Fetterolf et al. | 439/320 |
| 4,330,166 | 5/1982 | Cooper et al. | 439/609 |
| 4,382,653 | 5/1983 | Blanchard | 439/610 |
| 4,483,579 | 11/1984 | Derr et al. | 439/317 |
| 4,531,790 | 7/1985 | Selvin | 439/92 |
| 4,531,805 | 7/1985 | Werth | 439/607 |
| 4,544,224 | 10/1985 | Goodman et al. | 439/321 |
| 4,563,052 | 1/1986 | Dietrich | 439/610 |
| 4,583,809 | 4/1986 | Werth et al. | 439/585 |
| 4,588,247 | 5/1986 | Grappe et al. | 439/271 |
| 4,648,670 | 3/1987 | Punako et al. | 439/321 |
| 4,678,260 | 7/1987 | Gallusser et al. | 439/607 |
| 4,726,782 | 2/1988 | Hager et al. | 439/321 |
| 4,867,692 | 9/1989 | Kerek | 439/607 X |

*Primary Examiner*—Neil Abrams
*Assistant Examiner*—Khiem Nguyen
*Attorney, Agent, or Firm*—Thomas L. Peterson

[57] ABSTRACT

An electrical connector system is provided, of the type that includes housings of plastic-metal hybrid construction, which provides good moisture-tight sealing between the plastic shells and metal inserts and around grounding springs. The receptacle connector has a front edge to which the plastic shell and metal insert extend, and the plug connector includes a ring-shaped elastomeric first seal (90, FIG. 3) that is compressed by the front edge of the receptacle shell and insert (96, 98), to not only seal the inside of the mating regions of the connector but also to seal any slight gap (100) between the plastic shell and metal insert of the receptacle. The forward edge of the plug presses against a second elastomeric seal (92) which is on the receptacle, with the first and second seals sealing a region containing a grounding spring (80) that electrically connects the inserts of the plug and receptacle. Threaded connection between the plug and receptacle is through plastic threads (76, 78) on the outside of the receptacle shell and on the inside of the coupling nut on the plug. The system also includes a backshell device (24, FIG. 4) of similar construction.

10 Claims, 4 Drawing Sheets

10
12
14
15
16
18
20
22
24
30
32
34
36
40
42
44
5
5
80
90
92
164

HYBRID CONNECTOR

BACKGROUND OF THE INVENTION

Connector systems are commonly formed with a metal housing that contains an insulator that retains contacts. A weight reduction may be achieved for avionics applications, by constructing the housing of plastic, with a metal plating to guard against electromagnetic interference. However, inasmuch as a metal plating usually has a maximum thickness less than 0.002 inch, the metal cannot withstand severe electromagnetic pulses such as are produced by lightning or nuclear devices, in aircraft whose skins are constructed of composite materials rather than metal.

Another approach to reducing the weight of electrical connectors is to use a hybrid construction, where the connector housing includes a plastic shell that surrounds a metal insert, where the metal insert is of a thickness (generally at least 0.02 inch) at least an order of magnitude greater than that of a thick plating. However, this can give rise to difficulties in assuring that the hidden metal inserts of a mating plug and receptacle make good electrical contact with each other. Also, steps must be taken to protect the metal insert or other internal metal parts against corrosion, especially in the wide area where the outside of the metal insert lies against the inside of the plastic shell. A hybrid connector housing construction which assured good contact between the metal inserts of mating connectors, while protecting the metal inserts against corrosion, would be of considerable value.

SUMMARY OF THE INVENTION

In accordance with one embodiment of the present invention, an electrical connector system is provided, of the type that has a hybrid construction with a metal insert within a plastic shell, which assures good connection between the inserts of mating connectors while guarding the internal metal parts against corrosion. In a connector system with receptacle and plug connectors, the receptacle connector has a front edge to which its plastic shell and metal insert extend. The plug connector has a ring-shaped elastomeric seal positioned to be compressed by the front edges of both the shell and insert of the receptacle. This first seal therefore not only seals the inside of the mating connectors, but seals the interface area between the plastic and metal of the receptacle. The plug insert extends far forward of the plug shell, so the plug insert can carry a grounding spring to contact the inside of the receptacle insert. A second elastomeric seal lies deep within the receptacle insert to be compressed by the forward edge of the plug insert. The first and second seals therefore serve also to protect the grounding spring against corrosion.

A backshell device of hybrid construction can include two separate metal insert parts that are joined at the middle of the backshell device. The rearward part extends rearward of the plastic shell. A metal tube closely surrounds the portion of the rear insert part that extends rearward of the plastic shell of the backshell device.

The novel features of the invention are set forth with particularity in the appended claims. The invention will be best understood from the following description when read in conjunction with the accompanying drawings.

DESCRIPTION OF THE PREFERRED EMBODIMENT

Figure 1:
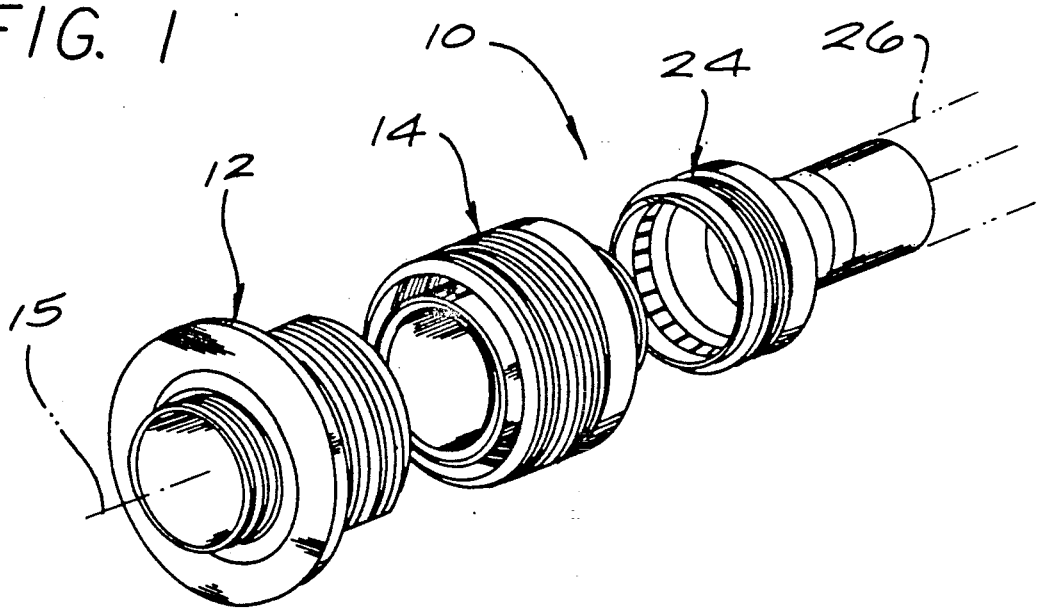
FIG. 1 is an exploded isometric view of a connector system constructed in accordance with the present invention, but showing only the housings of the connectors but not the contact-holding inserts thereof.
Figure 2:
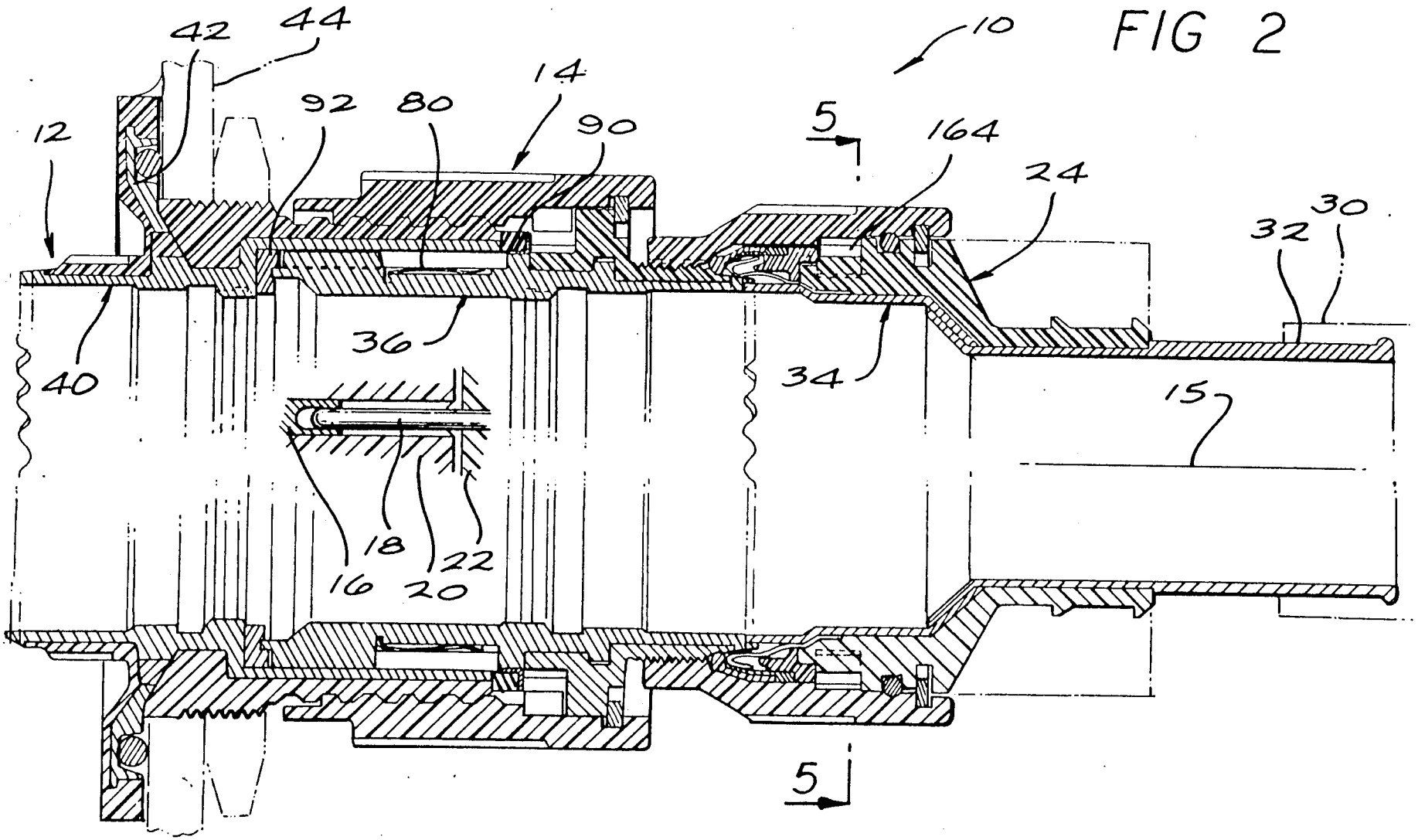
FIG. 2 is a sectional side view of the connector of FIG. 1, with all of the housing parts assembled and mated.

FIG. 1 illustrates an electrical connector system 10 which includes a receptacle connector 12, and a plug connector 14 that can be received in the receptacle connector when moved along a common axis 15. This figure shows only the housings of each connector 12, 14, each housing being used to hold an insert containing a plurality of electrical contacts (16, 18 in FIG. 2) that are held in an insulator (20, 22 in FIG. 2). A backshell device 24 connects to the rear of the plug connector and is used to hold a cable 26 to contact a grounding sheath of the cable and to provide room for wires of the cable to be connected to the rear of the plug contacts. As shown in FIG. 2, the grounded braiding 30 of the cable is connected to a termination region 32 of the backshell device. The termination region 32 is a part of a rear metal insert 34 of the backshell device. The rear insert 34 of the backshell device connects to a metal plug insert 36 which, in turn, connects to a metal receptacle insert 40. The receptacle insert 40 has a structure-contacting part 42 that contacts an electrically conductive support structure 44 that may be a wall of an airplane or of a box containing additional circuitry.

Figure 3:
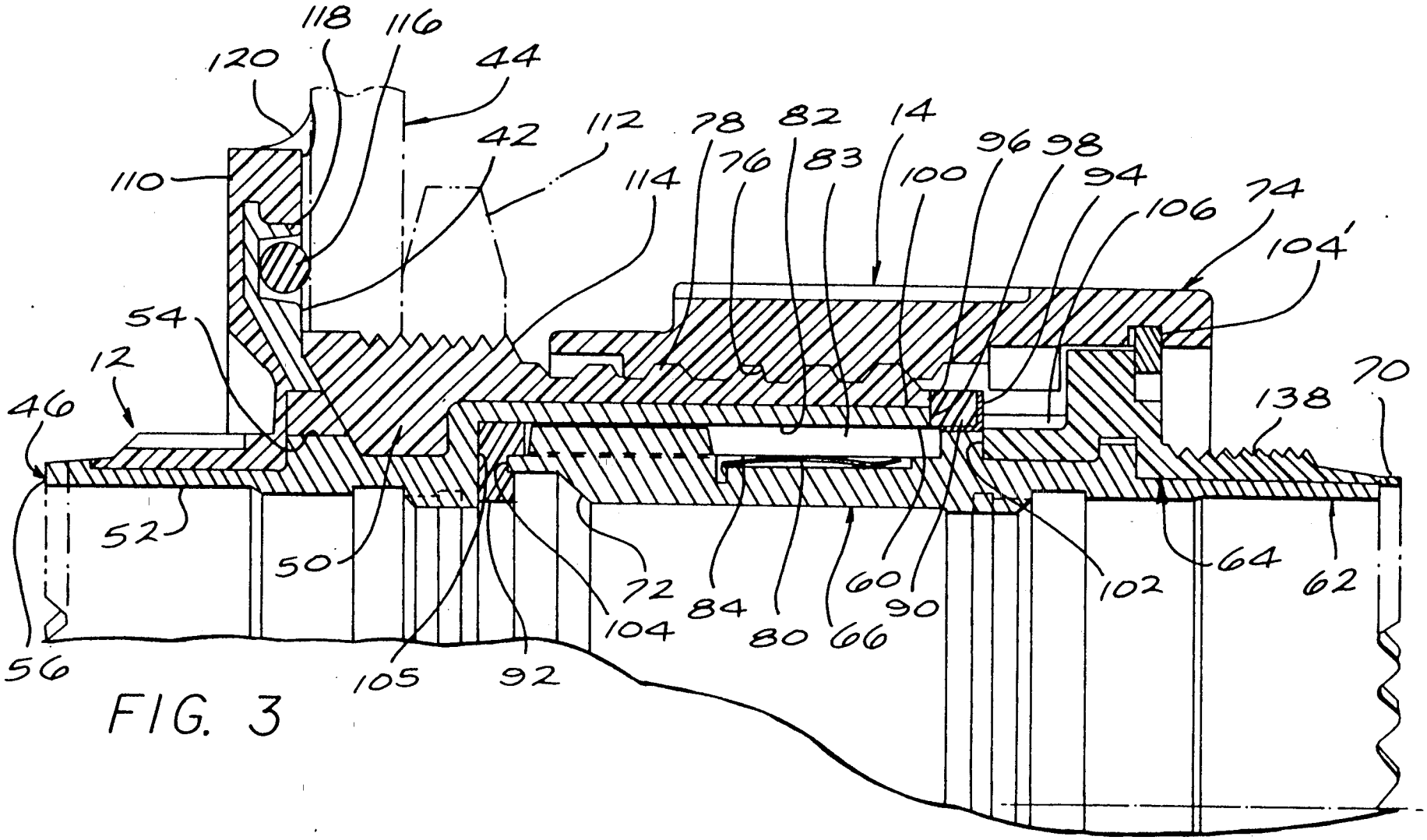
FIG. 3 is an enlarged view of a portion of the connector system of FIG. 2.

FIG. 3 shows details of the receptacle and connectors 12, 14. The housing 46 of the receptacle connector 12 is a hybrid type which includes a rigid plastic (high molecular weight polymer) shell 50 on the outside and a metal insert 52 on the inside. The insert 52 guards the contacts within the connector against electromagnetic interference, while the plastic shell 50 on the outside protects the metal insert from corrosion. In practice, the metal insert 52 is formed first and placed in a mold, and the plastic shell 50 is molded around the insert. The insert has various projections and other features that hold it tightly to the shell, one of them being a hole 54 in the metal insert through which plastic flows during forming of the shell to lock them together. The receptacle housing has a rear end 56 where the receptacle contacts can be accessed. It is not necessary to protect the rear end 56 against corrosion and the like where the rear end lies within a protected and EMI-shielded environment. The receptacle housing has a front end 60, which is the end that approaches the plug connector during mating. The plug connector 14 has a housing 62 that includes a plastic shell 64 and a metal insert 66 therewithin. The plug housing has a rear end 70 where it couples to the backshell, and has a front end 72 where it enters the receptacle housing during mating of the connectors. The plug connector also has a plastic coupling nut 74 with internal threads 76 that mate with external threads 78 formed on the receptacle plastic shell.

When the two connectors are brought together, the front end 72 of the plug is inserted within the front end 60 of the receptacle. During such insertion, the plug coupling nut 74 is turned to advance the connectors together to their fully inserted position. A grounding spring 80 is provided to assure good electrical connection between the plug metal insert 66 and the receptacle metal insert 52. The receptacle insert is formed with several slots 82 that pass through keys 83 in the plug insert. The grounding spring 80 is radially inwardly compressed during mating, and contacts an adjacent surface 84 on the receptacle insert. The grounding spring 80 is generally of spring-tempered metal, and must be especially protected from corrosion.

Two elastomeric ring-shaped seals 90, 92 seal the region containing the grounding spring 80 as well as other portions of the system. The first seal 90 is mounted on the outside of the plug metal insert 66, against a stainless steel flange 94 joined to the rest of the metal insert 66. The seal 90 is held in place by adhesive. As the plug and receptacle connectors become fully mated, the seal is compressed by the front end 60 of the receptacle housing. The front edge 96 of the receptacle shell and the front edge 98 of the receptacle insert lie even with each other, and both of them press against the first seal 90. As a result, the seal 90 seals a minute gap 100 between the plastic shell and metal insert. As discussed above, the plastic shell is molded around the metal insert and projections and other features hold them tightly together. However, a small gap can be present between them into which moisture or other corrosive material can enter, which will produce hidden corrosion. By using the seal 90 to seal the edges of the shell and insert, entrance of such material into the gap 100 is avoided. It may be noted that, in most uses, the plug and receptacle remain mated almost all of the time, and a sealing cover is normally placed over each of them when they are not mated.

The plug plastic shell 64 is constructed with its front edge 102 lying far rearward of the plug insert front edge 104. This leaves the forward portion of the metal insert accessible for electrical connection to the receptacle insert (through grounding spring 80). The second seal 92 is held, as by adhesive, to an internal forwardly-facing shoulder 105 of the receptacle insert, and is positioned so the forward edge 104 of the plug seal makes facewise contact with the second seal. Thus, as the plug and receptacle connectors are mated, the forward edges of each make contact with elastomeric seals of the other, to seal the region holding the grounding spring 80, as well as to seal the metal inserts and the interface between the receptacle shell and receptacle insert.

The plastic coupling nut 74 of the plug connector is captured by a snap ring 104' to the plug shell. A ratchet mechanism 106 which includes ratchet spring captured on the nut and ratchet teeth on the outside of the plug shell 64, serve to resist turning of the nut 74 to unmate the connectors as a result of vibration or the like.

The rear portion of the receptacle includes a flange portion 110 of the receptacle shell 50, which lies on the rear face of the support structure 44. A jamb nut 112 is threadably engaged with the threads 114 on the receptacle shell, holding the structure contacting part 42 of the receptacle metal insert tightly against the metal conductive support structure 44. An O-ring seal 116 seals the point of contact of the contacting part 42 to the support structure. Applicant prefers to have the O-ring 116 backed by metal of the insert, which results in the metal insert part at 118 not sealed by the O-ring. A sealant 120 can be used to seal the part 118 and the interface between the insert and shell, in a case where the environment at the rear of the support structure is not a highly protected one.

Figure 4:
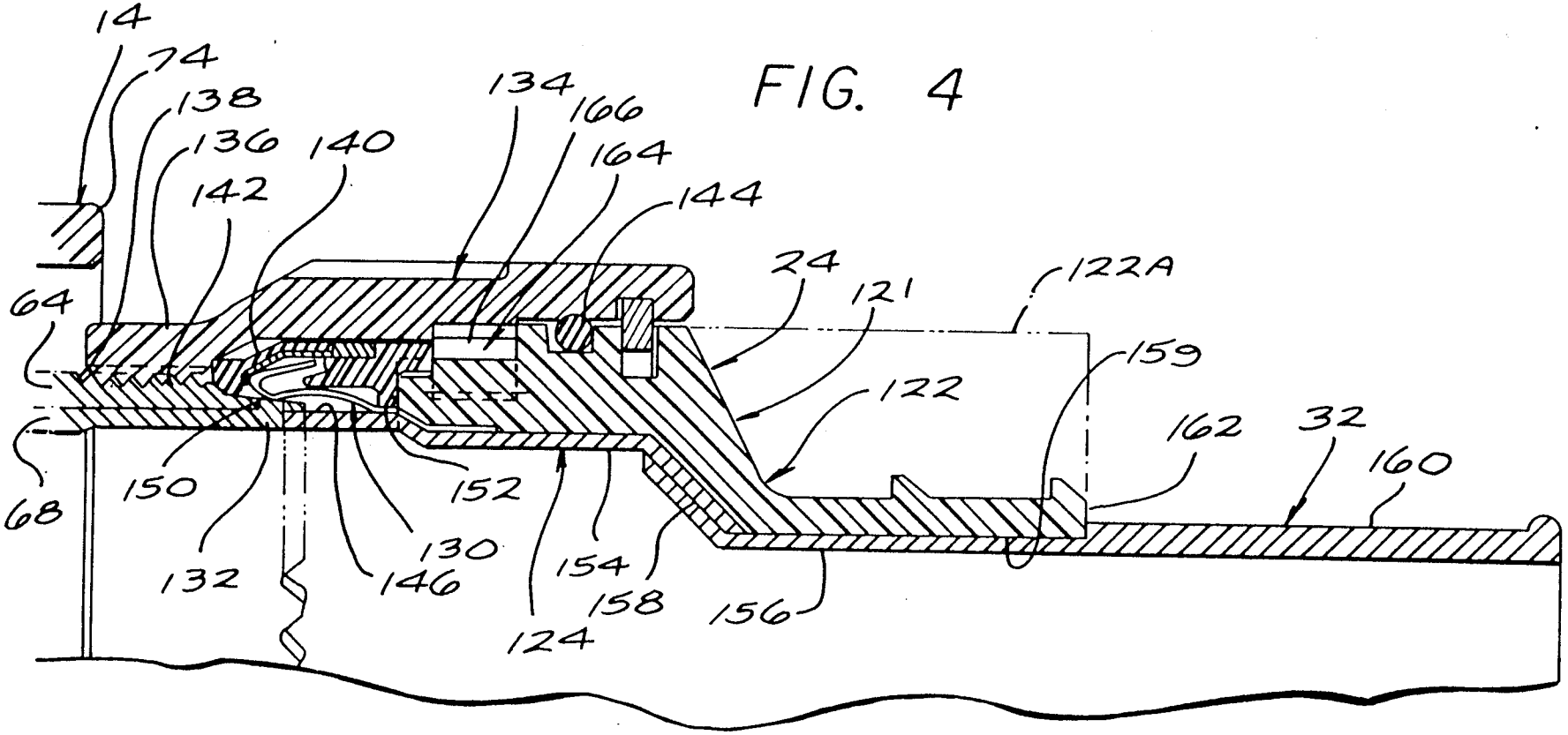
FIG. 4 is an enlarged view of another portion of the connector system of FIG. 2.

FIG. 4 illustrates the backshell device 24 which extends behind the plug connector 14 and is used to connect to the grounded shielding of the cable and to provide room for cable wires to connect to contacts of the plug connector. The backshell housing 121 is of hybrid construction, with a hard plastic device shell 122 and a metal insert 124. Typically, the backshell is placed around a cable, insulation at the front of the cable is stripped, and the cable wires are connected to contacts of the plug connector 14. The backshell device is then moved forward and the shielding of the cable (which is multi-strand metal rather than solid metal as is the metal insert) is connected to the termination region 32 of the backshell insert. The cable and backshell are then sealed to each other by a boot or similar means (not shown).

The backshell metal insert 124 includes a ground spring 130 which bears against a rear portion 132 of the plug insert to make a good electrical connection therewith. The backshell device includes a plastic coupling nut 134 with an internally threaded forward portion 136 that engages an external thread 138 on the plug connector to hold the backshell to the plug connector. A forward seal 140 at the forward portion of the coupling nut seals against a rear portion 142 of the plug shell 64. A rearward seal 144 seals the rear portion of the coupling nut to the plastic device shell !22 of the backshell device. This sealing arrangement seals the region 146 containing the grounding spring 130 which is especially susceptible to corrosion. The two seals 140, 144 also seal an end 150 of the interface between the plug shell 64 and the plug insert 66. The seals furthermore seal the interface end 152 between the device shell 122 and the insert 124 thereof.

The backshell metal insert 124 includes forward and rearward parts 154, 156 that are each in the form of tubing. The parts are bonded in a metallurgical overlap joint at 158. Both insert parts are formed of metal tubing. The two insert parts are provided to accommodate connectors of a variety of sizes. That is, the described connector is a military type which has nine different shell sizes ranging from 9 to 25 mm, and requires terminating regions 28 of three different lengths and as many as six different diameters within a shell size. Applicant uses a mold that initially forms the device shell to the configuration shown at 122A. For the particular connector size required, applicant then machines the rear of the shell at the outside and also bores the center of the shell at surface 159 to the desired diameter. The forward and rearward insert parts 154, 156 are then joined and inserted into the device shell. The terminal portion 32 of the insert is machined to the desired length and diameter, and inserted until it abuts the rear edge 162 of the device shell. The forward and rearward insert parts 154, 156 are joined as by brazing at 158. The interface at 162 is protected by a sealing boot over the cable jacket. Thus, the use of different parts to form the backshell insert enables the insert to be held tightly to the device shell of the backshell device, and allows device shells of a variety of sizes to be constructed using only one shell mold.

When the backshell coupling nut 134 is screwed onto the plug connector 14, loosening of the nut is prevented by a ratchet mechanism 164. The ratchet mechanism includes a ratchet spring captured on the shell 122, and which engages ratchet teeth 166 on the nut. It is desirable to make the ratchet mechanism of small diameter, so that the nut 134 is of small diameter, to provide room for unscrewing the coupling nut 74 on the plug connector. It is normal and desirable for the coupling nut of a backshell (e.g., 134) to be one size (2 mm) smaller than the coupling nut (e.g., 74) of the connector.

Figure 5:
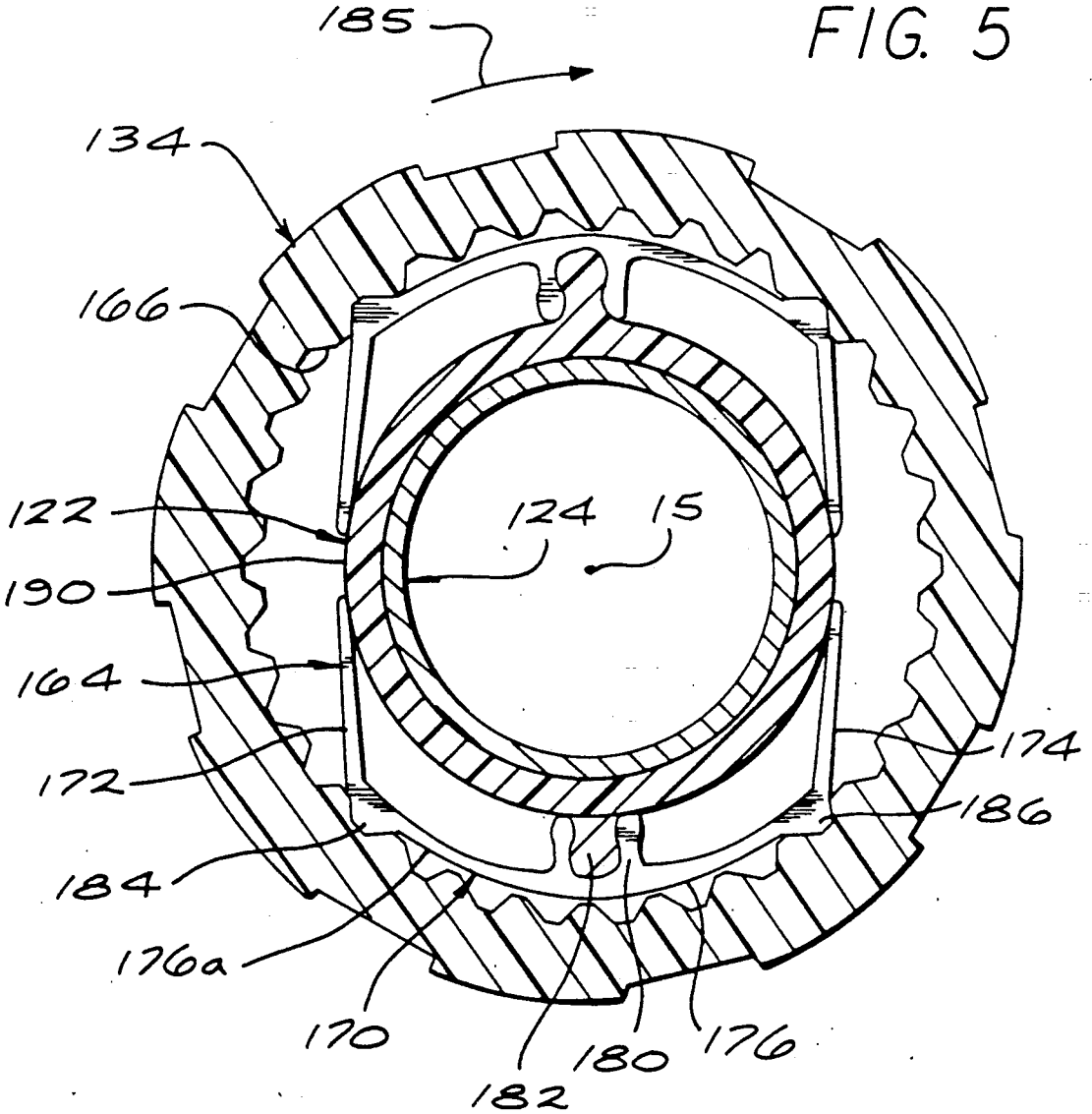
FIG. 5 is a view taken on the line 5—5 of FIG. 2.

FIG. 5 illustrates some details of the ratchet mechanism 164, which is inverted from the usual ratchet mechanism. The mechanism includes a plastic spring 170 which is of a largely U-shape, with opposite legs 172, 174 and a curved base 176 joining the legs. The middle of the base has a small radius loop portion 180 which is captured on a boss 182 formed on the outside of the device shell 122, which prevents rotation of the spring around the axis 15 of the backshell device and connector assembly. The joints 184, 186 where the base meets the legs 172, 174, form rounded protrusions that fit between the teeth 166 on the coupling nut 134. When the coupling nut 134 starts to rotate in either direction relative to the shell 122, especially in an uncoupling direction 185, the protrusions or joints such as 184 must be deflected inwardly by bending of one side such as 176*a* of the spring base 176. Adjustment of the relative angles between the protrusions 184 and the teeth 166 provide a greater force in the uncoupling direction than in the coupling direction. Resistance to such bending of one side such as 176*a* of the spring base causes resistance to turning of the coupling nut. It should be noted that the legs 172, 174 can easily slide slightly on the smooth outer surface 190 of the shell.

It should be noted that while the backshell device 24 is shown as extending behind the plug connector 14, it can also be used behind the receptacle connector 12 to connect to a grounded cable shielding and to provide room for connecting cable wires to connector contacts.

Thus, the invention provides an electrical connector system that includes parts of hybrid construction, with a plastic shell and a thick metal insert within the shell, which protects the insert and grounding springs between the parts, and which facilitates construction. The forward edges of the receptacle plastic shell and metal insert are even with each other, and both bear against an elastomeric seal on the plug, to not only seal the inside of the connector system, but also to seal the interface between the shell and insert. Another seal that engages the forward edge of the plug insert, provides a sealed region where a grounding spring lies that electrically connects the inserts of the receptacle and plug. The threaded connection between the coupling nut on one connector such as the plug, and the other connector such as the receptacle, is formed by plastic threading of the two parts. A backshell device is also of hybrid construction, but its metal insert includes a plurality of different insert parts to accommodate the need for backshell devices of a variety of diameters and lengths. The backshell insert parts can include a rearward part which is primarily of simple tubular construction, with a flared front that lies in a metallurgical lap joint with a more complicated forward insert part. A connector system of the described type, with an outer diameter of about one and one-quarter inches was able to transmit a simulated lightning pulse (decaying over a period of 140 microseconds) of 60,000 amperes without damage.

Although particular embodiments of the invention have been described and illustrated herein, it is recognized that modifications and variations may readily occur to those skilled in the art and consequently it is intended to cover such modifications and equivalents.

What is claimed is:

1. In an electrical connector system that includes a plug connector with a front end that can be received in the front end of a receptacle connector so they and their contacts are mated, and wherein each connector has a plastic-metal hybrid construction and includes a metal insert and a plastic shell lying about the metal insert, the improvement wherein:

said receptacle connector has a front edge and said receptacle plastic shell and metal insert both extend to said front edge with the front edges of said shell and insert being substantially even with each other;

said plug connector includes a ring-shaped elastomeric seal positioned to be compressed by the front edges of both said shell and insert as said receptacle is fully inserted, whereby to seal any possible space between said shell and insert.

2. The improvement described in claim 1 wherein:

said plug metal insert has a rear portion extending rearward of said plug shell; and including a backshell device connected to a rear portion of said plug connector, said backshell device having a plastic device shell and a metal back inset lying within said device shell, said back metal insert extending forward of said plastic device shell, and a back grounding spring connecting the front portion of said back metal insert and the outside of the rear portion of said plug metal insert;

said backshell device includes a plastic coupling nut rotatably mounted on said device shell but captured against forward and rearward movement thereon, and said backshell device also includes a rearward elastomeric seal sealed to said coupling nut and said device shell and a forward elastomeric seal sealed to said coupling nut and to said plug shell at a location forward of said back grounding spring.

3. The improvement described in claim 2 including:

a ratchet mechanism coupling said coupling nut to said plastic device shell, including a ring of ratchet teeth formed on an inner surface of said coupling nut;

said ratchet mechanism including a spring having a base and a pair of opposite legs connected at joints to opposite ends of said base, said legs having locations spaced from said joints with said leg locations bearing against said plastic device shell, said base has a middle captured by said plastic device shell, said joints forming protrusions engaged with said ratchet teeth.

4. In an electrical connector system that includes a connector having multiple contacts and having a front end that can mate with another connector and a rear end that couples to a cable with multiple conductors, and a backshell device coupled tot he rear of the connector, and wherein both said connector and said backshell device have a plastic-metal hybrid construction wherein each includes a solid metal insert and a hard plastic shell lying about the metal insert, the improvement wherein:

said backshell device metal insert includes forward and rearward insert parts, with the rear of said front part and the front of said rear part joined to each other;

said backshell rear insert part extending rearward of said backshell device plastic shell;

the front of said rearward insert part of said backshell device is tapered to have a progressively greater diameter at progressively more forward locations therealong, and said forward insert part has a tapered shoulder that substantially abuts the rear of said plastic shell and the front of said rearward insert part to be sandwiched therebetween, with said tapered shoulder of said forward insert part being joined to said front of said rearward insert part.

5. In an electrical connector system that includes a connector having multiple contacts and having a front end that can mate with another connector and a rear end that couples to a cable with multiple conductors, and a backshell device coupled to the rear of the connector, and wherein both said connector and said backshell device have a plastic-metal hybrid construction wherein each includes a metal insert and a plastic shell lying about the metal insert, the improvement wherein:

said connector insert has a rear part that extends rearward of said connector shell;

said backshell device includes a grounding spring with a rear part lying between the front of said backshell device metal insert and said backshell device shell, and a front part biased against the outside of said connector insert rear part.

6. In a connector system that includes first and second devices that are threadably connected, wherein the first device has a shell and an internally threaded plastic coupling nut surrounding and rotatable on the shell, and the second device has an externally threaded plastic shell that is engaged by the nut, the improvement of a mechanism for resisting rotation of the nut including:

a ratchet spring having a base and opposite edges, said base having a middle captured on said second device plastic shell and lying on the outside of said second device shell;

said nut has a plurality of ratchet teeth formed on its inside surface; and said ratchet spring has a pair of legs that joined to said base and has outward protrusions where each of said legs joins to said base, said protrusions being engaged with said ratchet teeth, and said legs having end portions bearing against the outside of said second shell.

7. The improvement described in claim 6 wherein:

said second plastic shell has a radially outward projection with an enlarged head;

said ratchet spring is a plastic molded part, and said spring middle closely surrounds said enlarged head.

8. A backshell for a connector having a rear end that couples to a cable with multiple conductors, said backshell being adapted to be coupled to the rear of the connector, and comprising:

a hollow plastic-metal hybrid body including a solid metal insert and a hard plastic shell lying about the metal insert;

said metal insert including forward and rearward insert parts, with the rear of said forward insert part and the front of said rearward insert part joined to each other; and said rear insert part extending rearward of said plastic shell;

the front of said rearward insert part is tapered to have a progressively greater diameter at progressively more forward locations therealong, and said forward insert part has a tapered shoulder that abuts the rear of said plastic shell and the front of said rearward insert part.

9. In an electrical connector system that includes a plug connector with a front end that can be received in the front end of a receptacle connector so they and their contacts are mated, and wherein each connector has a plastic-metal hybrid construction and includes a metal insert and a plastic shell lying about the metal insert, the improvement wherein:

said receptacle connector has a front edge and said receptacle plastic shell and metal insert both extend to said front edge;

said plug connector includes a ring-shaped first elastomeric seal positioned to be compressed by the front edges of both said shell and insert as said plug is fully inserted, whereby to seal any possible space between said shell and insert;

said plug metal insert has a forward portion that extends forward of the plug shell, and said plug forward portion includes a grounding spring lying forward of said plug shell but rearward of said forward edge of said plug insert and which contacts an inside of said receptacle insert when the connectors are mated; and including a second elastomeric seal;

said receptacle insert includes an internal forwardly-facing shoulder of about the same diameter as the forward edge of said plug, and also includes an elastomeric second seal lying forward of and against said shoulder;

said plug forward edge extending forwardly far enough to press against said seal as said receptacle front edge presses against said first seal, whereby to seal the region containing said grounding spring.

10. In an electrical connector system that includes a connector having multiple contacts and having a front end that can mate with another connector and a rear end that couples to a cable with multiple conductors, and a backshell device coupled to the rear of the connector, and wherein both said connector and said backshell device have a plastic-metal hybrid construction wherein each includes a metal insert and a plastic shell lying about the metal insert, the improvement wherein:

said backshell device metal insert includes forward and rearward insert parts, with the rear of said forward insert part and the front of said rearward insert part joined to each other;

said backshell rearward insert part extends rearward of said backshell device plastic shell;

said connector insert has a rear part that extends rearward of said connector shell;

said backshell device includes a grounding spring with a rear spring part lying between the front of said backshell device metal insert and said backshell device shell, and a front part biased against the outside of said connector insert rear part, said front of said backshell metal insert lying within said connector insert rear part;

said backshell device includes a plastic coupling nut surrounding said device shell, a rear elastomeric seal sealing the inside of said nut to the outside of said device plastic shell at a location rearward of said grounding spring, and a forward elastomeric seal sealing the inside of said nut to the outside of said connector plastic shell at a location forward of said grounding spring.

* * * * *